United States Patent [19]

Jepsen

[11] 4,417,855

[45] Nov. 29, 1983

[54] MOUNTING ASSEMBLY FOR HIGH SPEED TURBO DISCS

[75] Inventor: Robert E. Jepsen, Emmaus, Pa.

[73] Assignee: Air Products and Chemicals, Inc., Allentown, Pa.

[21] Appl. No.: 271,156

[22] Filed: Jun. 8, 1981

[51] Int. Cl.[3] ..... F01D 5/06

[52] U.S. Cl. ..... 416/244 A; 416/188; 403/29; 403/356; 403/365

[58] Field of Search ..... 416/188, 244 R, 244 A; 403/29, 30, 365, 356

[56] References Cited

U.S. PATENT DOCUMENTS

| | | | |
|---|---|---|---|
| 892,932 | 7/1908 | Buettner et al. . | |
| 1,873,956 | 8/1932 | Dahlstrand . | |
| 1,959,220 | 5/1934 | Robinson . | |
| 2,452,458 | 10/1948 | Hahn | 403/356 X |
| 2,799,445 | 7/1957 | Hull | 416/244 A UX |
| 3,077,334 | 2/1963 | Rubio et al. . | |
| 3,368,833 | 2/1968 | Chung . | |
| 3,543,899 | 12/1970 | Colbert | 192/107 |
| 3,698,750 | 10/1972 | Eastcott et al. | 416/244 A UX |
| 3,995,968 | 12/1976 | Campbell, Jr. et al. | 403/356 |
| 4,220,372 | 9/1980 | Johansen et al. | 301/1 |

FOREIGN PATENT DOCUMENTS

| | | | |
|---|---|---|---|
| 1256820 | 2/1961 | France | 416/244 A |

*Primary Examiner*—Philip R. Coe
*Assistant Examiner*—Joseph M. Pitko
*Attorney, Agent, or Firm*—Geoffrey L. Chase; E. E. Innis; J. C. Simmons

[57] ABSTRACT

A high speed turbo disc mounting assembly for the reduction of turbo disc failure and the provision for disc migration radially at high speeds comprising a shaft, a bushing mounted on said shaft having an annular flange through which torque pin apertures are provided, and a turbo disc mounted on said bushing such that torque pins aligned in channels at the interface of the disc and bushing provide for rotational engagement of the disc to the bushing without restricting outward migration of the disc or imparting undue stress concentrations to the high dynamic stress level area of said disc.

7 Claims, 5 Drawing Figures

FIG. 3
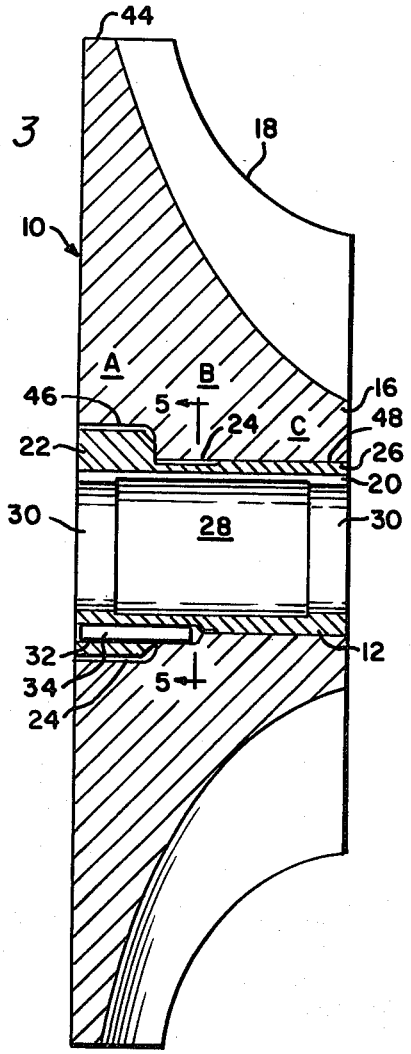
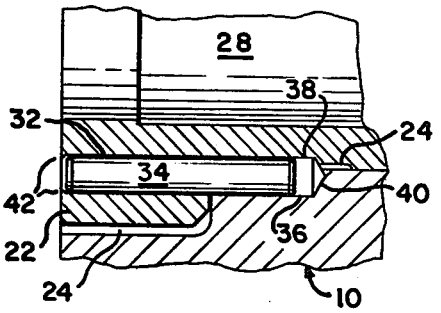
FIG. 4
FIG. 5
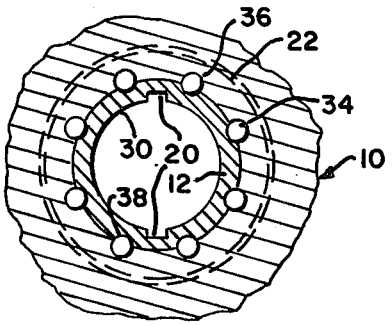

MOUNTING ASSEMBLY FOR HIGH SPEED TURBO DISCS

TECHNICAL FIELD

The present invention is directed to the field of mounting assemblies for high-speed turbo discs or turbine wheels which are mounted on drive shafts with various positive rotation imparting devices. These turbo discs and turbine wheels undergo tremendous dynamic stress forces with resultant distortion, stress crack failure, or migration of the assembly, particularly the disc or wheel itself. The high speed operational range of the equipment in this field is generally 800 to 1500 ft/sec tip speed. The turbo discs of this invention include radial flow impeller discs and expander discs.

BACKGROUND OF THE PRIOR ART

In the past, impellers, expanders, turbines and other high-speed rotational devices have suffered from the effects of stress cracking and failure, wobbling or uncentering of the mass of the device and displacement problems occurring when the mass of the rotating device migrates radially outward (elastic deformation) under the influence of centrifugal force during high speed operation.

Attempts have been made to secure such rotational devices to their respective drive shafts to avoid these drawbacks yet at the same time insure transmission of torque between the drive shaft and the rotational device. Various uses of splines, keys and locating pins have been utilized, but most of such fastenings have created points of stress concentration such as occur when restricting the outward concentric or eccentric migration of the rotational device during high speeds.

The prior art has made various attempts to secure rotational devices of significant mass to an axle or drive shaft so as to provide positive rotational engagement of the device. Numerous attempts have been made to overcome the problems attendant with providing positive rotational engagement while preventing stress crack failure and accommodating for the known distortion and concentric migration of large mass devices undergoing significant rotational and therefore centrifugal forces and other dynamic stresses, such as hoop stress.

In U.S. Pat. No. 892,932 a mounting means is provided for a drive gear and a sprocket gear wherein a pin is positioned in a slot which is fabricated with one-half of its diameter in one gear and the other half of its diameter in the second gear. A portion of the pin is entirely set within the first gear.

U.S. Pat. No. 3,995,968 discloses a turbine rotor and disc assembly in which a pin is placed at the interface of the disc and rotor. A bushing is not provided between the rotor and the disc.

In U.S. Pat. No. 3,077,334 the problem of dynamic stress in high-speed turbine wheels is documented. However, the recited solution to the problem regarding dynamic stress in the turbine wheel is the use of radially aligned pins placed at the outermost edges of the turbine wheel bore.

U.S. Pat. No. 3,368,833 discloses the mounting of a drive wheel on a bushing by the utilization of a combination of threaded screws of long configuration and of short tapered configuration. The screws are designed to apply significant pressure respectively axially and radially on the bushing and drive wheel assembly. The frictional fit between the bushing and drive wheel is provided by the forced action of the screws against the tapered fit of the former elements.

In U.S. Pat. No. 4,220,372 a wheel and axle assembly is disclosed which utilizes a combination of pins and bolts to secure a wheel hub to an axle by means of a clamping bushing element. However, the bolts fully immobilize the hub with respect to the axle and the bushing in this low speed application of wheel mounting technology.

Finally in U.S. Pat. No. 1,873,956 the problem of rotor expansion under high-speed conditions is recognized, but the use of a spring steel element to secure the rotor to the axle is taught rather than a shrink or interference fit in combination with axial pins.

The present invention overcomes the short comings of the prior art by the use of a combination of an interference fit in the low-stress area of a high-speed turbo disc-bushing interface, as well as the placement of torque pins in such an interface to preclude radial containment of the disc and to diminish concentrations of dynamic stress in the disc mass while at the same time preventing eccentric migration of the disc. This invention further stabilizes the mounting assembly of a turbo disc by fully encasing the torque pins, which provide positive rotational engagement, within the flange of a bushing in the vicinity of greatest dynamic stress of the turbo disc mass.

The unique mounting assembly of the present invention provides: (a) transmission of torque to and from the turbo disc with positive engagement without detrimental stress concentration; (b) adequate centering, both static and dynamic, of the turbo disc on the drive shaft by utilization of the bushing of the present invention intermediate of the turbo disc and the drive shaft; and (c) ease of assembly of the turbo disc onto the shaft without the need to disturb the torque pins in their placement. Additionally, the mounting assembly can be fabricated without special tools by simple drill press and lathe equipment.

BRIEF SUMMARY OF THE INVENTION

The present invention is directed to a high-speed turbo disc mounting assembly which provides for improved performance in overload and high rotational force and dynamic stress conditions which can exist at an operational range typically of 800 to 1500 ft/sec tip speed. The invention precludes premature stress failure of the turbo disc and allows for freedom of turbo disc concentric migration at high-speeds by the unique fabrication of the turbo disc mounting assembly which comprises a typical drive shaft, a bushing mounted on said shaft by means of an interference fit and having an annular flange projecting radially outward from the bushing through which a plurality of torque pin apertures are machined with partial aperture dimensioned channels projecting along a portion of the remaining bushing, a turbo disc mounted on said bushing with partial torque pin aperture channels corresponding to those of said bushing, and a plurality of torque pins which are axially aligned in the torque pin apertures and the corresponding channel sections such that the pins reside at the interface of the turbo disc and the bushing so as to provide rotational engagement of the disc and the bushing without restricting outward concentric migration of the disc under high centrifugal force conditions, yet precluding eccentric migration of the disc.

It is an object of the present invention to locate the apertures and corresponding channel sections such that the axis of each of the torque pins is positioned radially outward from the interface of the bushing and the turbo disc.

It is another object of the present invention that the radially outward projecting flange on the bushing be of sufficient axial length to preclude exposure of the high-stress area of the turbo disc to contact by the various torque pins.

A further object of the present invention is directed to the provision of torque pins sufficiently shorter than the total length of the aperture and channel section combinations so as to preclude creation of undue stress during insertion of the pins into their respective positions in the mounting assembly or during operation.

Yet another objective of the present invention is to provide an interference fit between the turbo disc and its bushing only at the low-stress area of the turbo disc which corresponds to the small diameter area or hub of the turbo disc wherein stress is at a minimum and may be directed in a compressive or radially inward direction.

Preferably the turbo disc is fabricated from aluminum while the bushing is fabricated from steel.

Another object of the present invention is to utilize the turbo disc mounting assembly for either impeller discs or expander discs.

BRIEF DESCRIPTION OF THE DRAWINGS

The present invention will be more fully understood from the following drawings, in which:

FIG. 3 is a cross-sectional view of FIG. 1 taken along the line 3—3;

FIG. 4 is a partial view of the cross-sectional view of FIG. 3 shown in enlargement;

FIG. 5 is a cross-sectional view of FIG. 3 taken along the line 5—5.

DETAILED DESCRIPTION OF THE INVENTION

The preferred embodiment of the present invention will be described below in which similar numerals and letters will be utilized to describe the similar elements in all the drawings and the text below.

Figure 1:
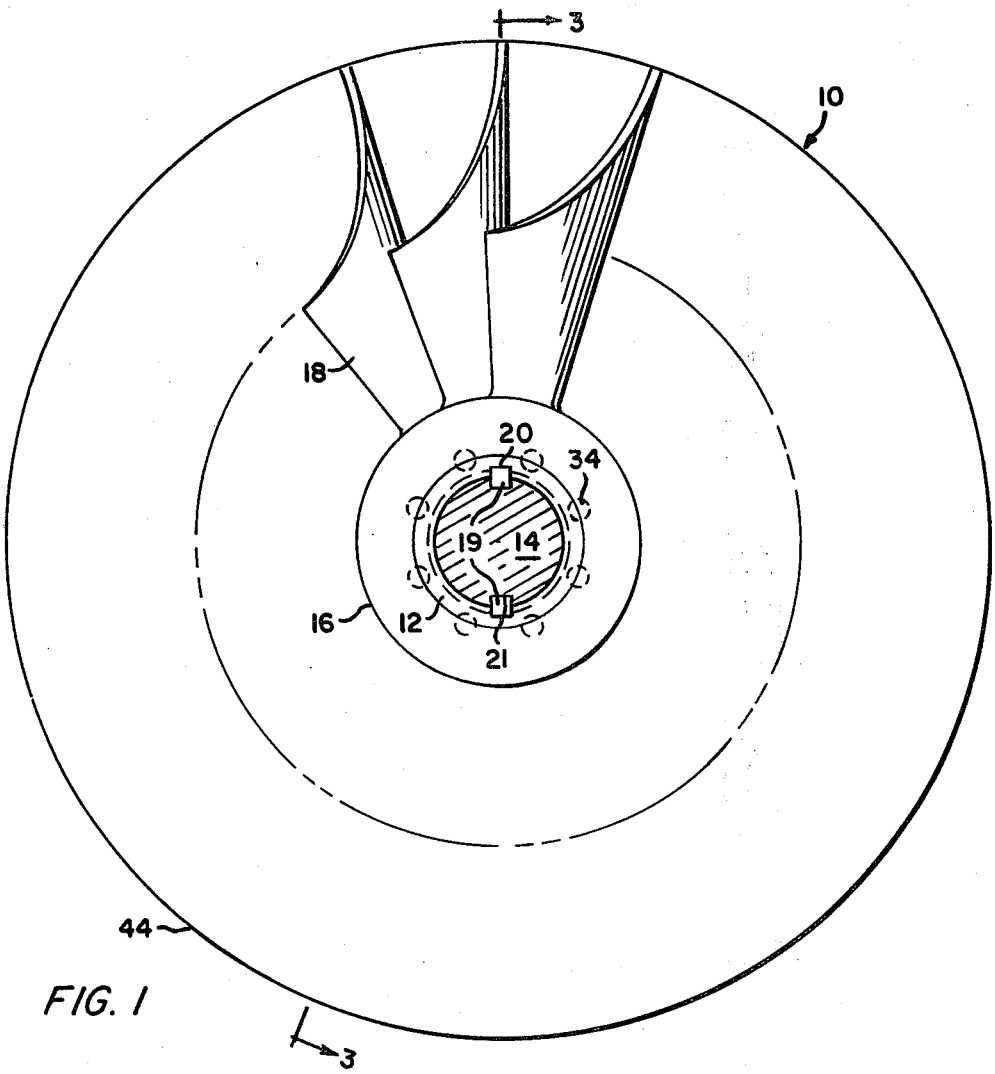
FIG. 1 is an elevational view of the front of the turbo disc mounting assembly showing an impeller with a representative number of the impeller blades.

In FIG. 1, a turbo disc is shown having the mounting assembly of the present invention. The invention is equally applicable to various turbo discs of the radial flow type whether they are used for fluid compression, that is impellers, or for fluid expansion, that is expanders. However, the following description will be made with reference to an impeller, which generally differs from an expander only in the profile of its blades and the direction of rotation. An impeller disc 10 having impeller blades 18 is mounted on a bushing 12 which in turn is mounted on a drive shaft 14. The drive shaft may be hollow or solid. The impeller disc comprises a small diameter portion or hub 16 and a large diameter portion 44.

The impeller disc 10, as shown in FIG. 3, is affixed to the bushing 12 by an interference fit which is created by subjecting the bushing to liquid nitrogen, inserting the bushing in the bore 46 and 48 of the disc 10 and allowing the bushing 12 to expand within the impeller disc until the bushing resumes its original size, which expansion provides an interference fit between a portion of the interface of the bushing and impeller disc. The interference fit is achieved by dimensioning the two parts so that a portion of the outside diameter of the bushing is slightly larger than the inside diameter of the impeller disc bore 48. In addition to the interference fit, the bushing 12 and the impeller disc 10 are engaged for rotational movement by a plurality of axially aligned torque pins 34. Preferably, eight pins are utilized at the interface between the bushing and the impeller disc. In turn, the bushing 12 is mounted on the drive shaft 14 by an interference fit between the bore 28 of the bushing and the circumferential surface of the drive shaft 14. Positive rotational engagement is assured by matching key ways 20 and 21 in the bushing and shaft, respectively, wherein a key 19 is frictionally retained.

Figure 2:
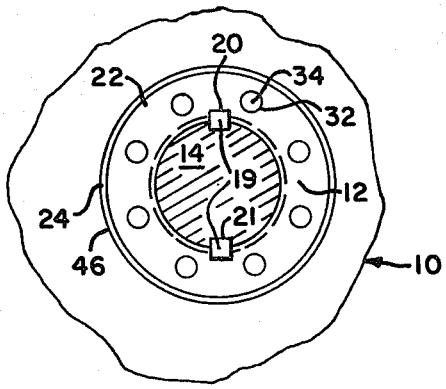
FIG. 2 is a partial elevational view of the back of the turbo disc mounting assembly.

In FIG. 2 the reverse side of the impeller mounting assembly is shown. The impeller disc 10 with its large diameter portion 44 is mounted on the bushing 12 which has a relatively large diameter radially outward projecting annular flange 22 that fits within an enlarged diameter portion of the impeller disc. This flange has a plurality of torque pin apertures 32 formed within it in an axially aligned pattern. As similarly illustrated in FIG. 1, FIG. 2 shows the mounting of the bushing 12 on the drive shaft 14 by alignment of corresponding key ways 20 and 21 and the engagement of a key 19. The interface between the bore 46 of the impeller disc 10 and the flange 22 of the bushing 12 provides a loose or clearance fit 24 wherein the respective surfaces are dimensioned such that frictional engagement of said surfaces is not achieved. This clearance fit is preferably of the order of five thousandths of an inch per inch of diameter.

In FIG. 3, a cross-section of the turbo disc mounting assembly is shown. The impeller disc 10 consists of a large diameter portion 44 and a small diameter portion or hub 16. Arranged on the front surface of the impeller 10 is a series of impeller blades 18. The construction of the impeller disc in this manner creates an increased mass area "A" in the vicinity of the large diameter portion 44. Respectively, a low mass area "C" exists in the vicinity of the hub 16 wherein the impeller is of a small diameter. During high speed rotation, the impeller disc undergoes a varying amount of stress dependent upon the varying amount of mass as shown in "A", "B", and "C" and dependant on the varying distance from the impeller axis. The region "A" undergoes a high level of stress due to the effect of centrifugal forces and other dynamic stresses, such as hoop stress on the large mass area. The region "B" undergoes a lesser degree of stress due to the decreasing amount of mass in that region which is subject to dynamic stresses during high speed rotation. Because of the dimension of the mass in regions "A" and "B", the mass of the impeller disc in region "C" actually experiences a reverse or compressive form of the centrifugal force component of the dynamic stress experienced by the other two regions. In other words, the force component is experienced in a radially inward vector direction. At some point between region "B" and region "C" there exists a theoretical pivot point or fulcrum at which the mass from region "A" and "B" attempts to rotate during the stress of high centrifugal forces during high speed operation. This same effect produces the net reverse force loads on region "C" despite the centrifugal forces which also operate in that region. Because of this dynamic situation, the mounting of the impeller disc by an interference fit along its entire bore is not satisfactory. The impeller tends to migrate radially outward away from whatever it is fit against in the region "A" of the disc, and to a lesser degree in the region "B". In addition, any bolts or pins used in this region for rotational engagement tend to be an initiation point for stress fractures. Therefore, the mounting construction of the turbo disc-bushing assembly of the present invention provides a unique utilization of the stress experienced by the turbo disc while at the same time the construction of the assembly avoids inducing a concentration of stress at a point in the area of high mass and high stress of the turbo disc.

As shown in FIG. 3, the impeller disc 10 has a stepped bore consisting of a large diameter bore 46 and a small diameter bore 48. This bore configuration fits the exterior shape of the steel bushing 12 which is inserted within the bore of the impeller disc 10. The bushing 12 has a radially outward projecting flange 22 which is of greater diameter than the diameter of the remaining neck 26 of the bushing. The flange 22 is dimensioned to be of sufficient radial thickness to incorporate a plurality of apertures 32 in the body of the flange. The flange is also of sufficient axial length to be juxtaposed to the entire bore surface area 46 of greatest stress of the impeller disc 10, specifically region "A", without contacting the same, i.e. a clearance fit. The bushing 12 is mounted on the drive shaft 14 by a light shrink or interference fit. Although the interference fit could encompass the entire length of the bushing bore 28, preferably the interference fit is only provided in the end regions 30 of the bushing bore 28. These interference fit regions 30 in conjunction with the keys 19 incorporated in the key ways 20 and 21 are sufficient to provide frictional and rotational engagement, respectively, of the bushing with the drive shaft. This fit is not as tight as the fit of the bushing to the disc in order to facilitate mounting and removal operations.

The bushing and impeller disc interface formed by the outside diameter of the bushing and the inside diameter of the disc bore comprises a clearance or loose fit 24 and an interference fit in the area of region "C" of the disc and bushing neck not juxtaposed to the torque pin channels. In addition to this frictional engagement, the bushing and disc are mechanically linked by a plurality of torque pins 34. Preferably, eight torque pins 34 are used for this engagement. The pins are placed within apertures 32 in the bushing flange 22 and in channels 36 and 38 within the interface between the bushing neck and the small diameter bore 48 of the impeller disc 10. The alignment of the pins is best viewed in FIG. 4.

As shown in FIG. 4, wherein only one of the plurality of torque pins 34 is shown, the bushing flange 22 is fabricated with a torque pin aperture 32 running in axial alignment through the flange and further deliniated in the bushing neck 26 and the impeller disc small diameter bore 48 by partial cylindrical channels 38 and 36 formed in the respective component bodies. Together these channels form an extension of the torque pin apertures 32. By placing the torque pins at the interface of the disc and bushing, the pins do not prevent outward concentric migration of the disc during operation and thus reduce potential stress buildups and concentrations during such radially outward migration of the disc. However, the pin placement does constrain eccentric migration of the disc, but without stress concentration. The bore formed by the channels 36 and 38 are machined to a length greater than the pin 34 utilized within said bore. The extra length of these channels provides a channel free space 40 which prevents the torque pins 34 from exerting strain or stress on the material of the impeller disc 10 during placement of the pin 34 or during operation. As shown in the figure, the axis of the channel bore, and therefore the torque pin 34, lies in the stock of the impeller disc 10. In other words, the channels 36 and 38 are not of equal depth in their respective component bodies. The disc channel 36 deliniates a greater circumferential dimension of the bore for the torque pins 34 than does the bushing channel 38. Because of this alignment of the channels, the pins 34 exert rotational force against the impeller disc 10 over a greater area of circumferential engagement of the pin and the impeller channel 36 than the pin is exposed to on the surface area of circumferential engagement of the bushing channel 38. This is in keeping with the existence of greater stress forces on the large mass impeller disc 10 than respectively exists on the relatively smaller bushing 12. It also is in keeping with the preferred materials utilized to fabricate the bushing and impeller disc, namely; steel and aluminum, respectively. However, other materials can be used to form the disc, including: bronze, magnesium, titanium and steel. The preferred aluminum stock of the impeller disc 10 will not meet the same levels of stress as will the steel material of the bushing 12. Therefore, greater surface area is provided in the channel 36 of the impeller disc 10 than in the channel 38 of the bushing 12.

However, in order to avoid stress being imparted by the torque pin against the impeller disc in the region "A" of the disc where high stress levels exist under operational conditions, the torque pin 34 is fully encased in the radially extended flange 22 of the steel bushing in that area. By locating the apertures for the torque pins entirely within the bushing in this region, the potential concentration of stress of rotational engagement exerted by the torque pins is precluded from being exerted upon the stock of the impeller disc 10 where it is most subject and vulnerable to such stress.

The orientation of the torque pin apertures consisting of channels 36 and 38 is best viewed in FIG. 5. This sectional view of FIG. 3 taken along the region "B" of the impeller mounting assembly shows the alignment of the axis of the torque pin apertures well within the stock of the impeller disc 10 rather than the stock of the bushing 12.

In constructing the turbo disc mounting assembly of the present invention, the bushing 12 is first machined to an initial base dimension and then the torque pin apertures 32 are drilled entirely within the stock of the bushing. Subsequently, the bushing is further machined in a lathe turning operation to remove material sufficient to expose the inner sections of the apertures and reduce these sections of the apertures to open channels 38. In so doing, the final dimension of the flange 22 is formed, the extent of which dimension is dependent upon the calculated area of high stress region "A" of the disc which will be matched with the bushing and is also dependent as well on the disc size, the disc material, the intended operational speeds of the assembly and the amount of torque transmitting surface of the pins 34 that must be exposed to the disc. The completed bushing is then affixed in the bore 46 and 48 of the disc 10. The interference fit in region "C" is achieved by chilling the bushing with liquid nitrogen or other means during the insertion process. Alternately, the disc may be heated to provide the necessary clearance for fitting. After the bushing 12 is rigidly affixed in the disc 10 the torque pin apertures 32 and channels 38 are used as templates for the drilling of the channels 36 in the disc 10. In this manner, an exact match-up of the torque pin aperture 32, the bushing channel 38 and the disc channel 36 is provided. At this point, the torque pins 34 are inserted in the apertures 32 with a snug fit and retained by staking or swaging the edges 42 of each aperture, as shown in FIG. 4. The turbo disc-bushing assembly is then ready to be mounted by an interference fit onto a drive shaft 14. Preferably, the interference fit is limited to regions of the bushing bore 28 at opposite ends 30 of the bushing. The mounting of the bushing on the drive shaft can be done in any of the traditional manners such as cold shrinking the drive shaft to accommodate the bushing bore, or heating the turbo disc mounting assembly to fit over the shaft. The drive shaft has a shoulder against which the bushing flange 22 abuts during mounting. The shaft is threaded either externally for a nut or internally for a bolt to retain the turbo disc-bushing assembly on the end of the shaft against the shoulder of the shaft. Such a fastening is not shown as it is deemed to be well within the skill of the art.

Various modifications to the apparatus described with reference to the accompanying drawings are envisioned, such as the number of pins 34 utilized or the area of the interference fit 30, and these modifications are deemed to be within the scope of the invention as claimed below.

I claim:

1. A high speed turbo disc mounting assembly comprising:

(a) a shaft for transmitting rotational force to and from said disc assembly;

(b) a bushing mounted on said shaft by an interference fit between at least a portion of the bore surface of said bushing and the circumferential surface of said shaft, said bushing including a relatively large diameter annular flange projecting radially outward at one end of said bushing through which a plurality of axially aligned torque pin apertures are formed within said flange but which form only partial cylindrical channels in the surface of the bushing adjacent said flange;

(c) a turbo disc mounted on said bushing consisting of a relatively large diameter portion and a relatively small diameter portion and having a stepped axial bore, which consists of a large diameter bore adjacent the disc's large diameter portion and a small diameter bore adjacent the disc's small diameter portion, said disc having a plurality of partial cylindrical torque pin channels in the portion of said small diameter bore immediately adjacent said large diameter bore such that said channels correspond to the channels in said bushing, and form an extension of said torque pin apertures, said disc having an interference fit with said bushing only in the area of said small diameter bore of said disc not juxtaposed to said channels;

(d) a plurality of torque pins located axially in the apertures and corresponding channels of said bushing and engaging the channels in the bore of said turbo disc for the transmission of torque between said bushing and said turbo disc without restraint of the outward migration of said disc during high speed operation, wherein said pins are fully encased in the flange of said bushing adjacent a high dynamic stress area of said turbo disc and are only partially engaged circumferentially in said turbo disc bore at its area of lower dynamic stress such that radially outward migration of the disc is not prevented by the torque pins.

2. The invention of claim 1 wherein the axis of the torque pins is positioned radially outward from the disc-bushing interface in the stock of the turbo disc.

3. The invention of claim 1 wherein the flange of the bushing is of sufficient axial length to prevent exposure of the torque pins to the turbo disc at the area of the disc's large diameter portion wherein the greatest dynamic stress is experienced by said disc.

4. The invention of claim 1 wherein the torque pins are dimensioned axially shorter than the corresponding torque pin apertures such that stress is not induced in the mounting assembly by said pins during their placement or during operation.

5. The invention of claim 1 wherein the turbo disc is fabricated of aluminum and the bushing is fabricated of steel.

6. The invention of claim 1 wherein the turbo disc is an impeller for compressing fluids.

7. The invention of claim 1 wherein the turbo disc is an expander for expanding fluids.

* * * * *